US006390936B1

(12) United States Patent
Sugimoto

(10) Patent No.: US 6,390,936 B1
(45) **Date of Patent: *May 21, 2002**

(54) THREE-PIECE SOLID GOLF BALL

(75) Inventor: Kazushige Sugimoto, Akashi (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/349,920

(22) Filed: Jul. 8, 1999

(30) Foreign Application Priority Data

Jul. 13, 1998 (JP) ..... 10-197085
May 7, 1999 (JP) ..... 11-127151

(51) Int. Cl.[7] ..... A63B 37/06
(52) U.S. Cl. ..... 473/374; 473/373
(58) Field of Search ..... 473/373, 374, 473/377, 378

(56) References Cited

U.S. PATENT DOCUMENTS 4,714,253 A * 12/1987 Nakahara et al. ..... 473/373
4,863,167 A * 9/1989 Matsuki et al. ..... 473/373
5,002,281 A * 3/1991 Nakahara et al. ..... 473/373
5,048,838 A * 9/1991 Chikaraishi et al. ..... 473/373
5,072,944 A * 12/1991 Nakahara et al. ..... 473/373
5,607,366 A * 3/1997 Yokota et al. ..... 473/372
5,766,096 A * 6/1998 Maruko et al. ..... 473/365
5,782,707 A 7/1998 Yamagishi et al.
5,803,834 A 9/1998 Yamagishi et al.
5,830,085 A * 11/1998 Higuchi et al. ..... 473/373
5,935,022 A * 8/1999 Sugimoto et al. ..... 473/373

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

A three-piece solid golf ball has excellent flight performance when hit by a driver or a long or a middle iron, and good spin performance when hit by a short iron or approach-shot. The three-piece solid golf ball has a core with a center and intermediate layer on the center; a cover on the core, the center with diameter 29 to 38 mm, hardness difference in JIS-C hardness at any point between its center to surface not more than 7, specific gravity lower than the intermediate layer, the surface hardness in JIS-C hardness of the intermediate layer being higher than the hardness determined at any point in the center; the difference between surface hardness of intermediate layer and hardness at any point in center being within 3° to 20° JIS-C, and cover having a Shore D hardness of less than 60.

7 Claims, 1 Drawing Sheet

THREE-PIECE SOLID GOLF BALL

FIELD OF THE INVENTION

The present invention relates to a three-piece solid golf ball. More particularly, it relates to a three-piece solid golf ball which has both excellent flight performance when hit by a driver or a long iron club or a middle iron club, and good spin performance as the ball easily stops on a green, when hit by a short iron club or approach-shot.

BACKGROUND OF THE INVENTION

Amateur golfers generally regard flight distance as most important factor for golf balls and preferably use a golf ball having good rebound characteristics and little spin amount, such as a solid golf ball. On the other hand, professional golfers and high level-amateur golfers generally regard controllability or spin performance as most important factor for golf balls, and therefore use a golf ball having high spin performance, which is a performance easily putting spin on a golf ball, such as a thread wound golf ball or a spin type solid golf ball. In the context, the golf balls are classified into two groups, one of which is a high spin type golf ball and the other is a long flight distance type golf ball.

However, in the golf balls which have been hitherto developed, in case where flight distance is made preferential, spin performance is lowered, and in case where spin performance is made preferential, flight distance is adversely lowered. For improving the problem, it is proposed in Japanese Patent Kokai Publication Nos. 239068/1997, 239067/1997 etc. that a hardness of a core of a solid golf ball is adjusted to a proper distribution to improve shot feel when hitting and controllability without damaging the long flight distance inherent to the solid golf ball.

Japanese Patent Kokai Publication No. 239068/1997 suggests a three-piece solid golf ball which comprises a core, an intermediate layer and a cover. The core has a center hardness in JIS-C hardness of not more than 75 and a surface hardness in JIS-C hardness of not more than 85, the surface hardness of the core is higher than the center hardness of the core by 8 to 20, the hardness of the intermediate layer is higher than that of the surface of the core by not less than 5. The hardness of the cover is lower than that of the intermediate layer by not less than 5, and a ratio of dimple area to surface area of the golf ball is not less than 62%.

Japanese Patent Kokai Publication No. 239067/1997 suggests a two-piece solid golf ball which comprises a core and a cover. The core has a surface hardness in JIS-C hardness of not more than 85, a center hardness of the core is lower than the surface hardness of the core by 8 to less than 20. A hardness of from the surface to 5 mm from the surface of the core is lower than a surface hardness of the core by not more than 8. A hardness of the cover is higher than the surface hardness of the core by 1 to 15. A thickness of the cover is 1.5 to 1.95 mm, and a number of dimples is 360 to 450.

In the golf balls of the above publications, the shot feel and controllability are improved, but the rebound characteristics are degraded, which reduces flight distance, because the hardness difference between the center of the core and the surface of the core is large.

It is required by not only amateur golfers but also professional golfers to solve the above problem and to provide a golf ball having longer flight distance and better controllability.

OBJECTS OF THE INVENTION

A main object of the present invention is to provide a three-piece solid golf ball which has both excellent flight performance when hit by a driver or a long iron club or a middle iron club, and good spin performance as the ball easily stops on a green, when hit by a short iron club or approach-shot.

According to the present invention, the object described above has been accomplished by adjusting a diameter and hardness distribution of the center, the difference in hardness and specific gravity between the center and intermediate layer and a hardness of the cover to specified ranges, thereby providing a three-piece solid golf ball which has both excellent flight performance when hit by a driver or a long iron club or a middle iron club, and good spin performance as the ball easily stops on a green, when hit by a short iron club or approach-shot.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accomplishing drawings which are given by way of illustrating only, and thus are not limitative of the present invention, and wherein.

SUMMARY OF THE INVENTION

Figure 1:
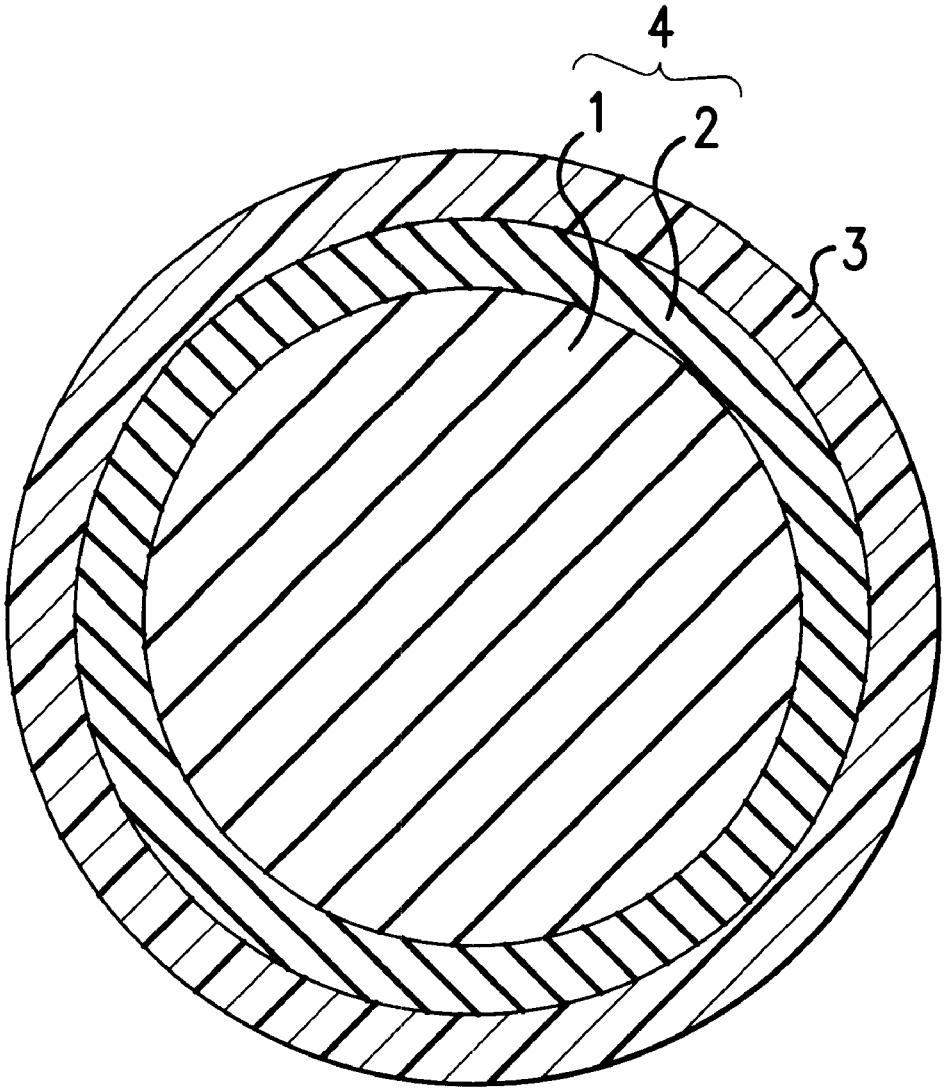
FIG. 1 is a schematic cross section illustrating one embodiment of the golf ball of the present invention.

The present invention provides a three-piece solid golf ball comprising a core composed of a center and an intermediate layer formed on the center, and a cover covering the core, wherein the center has a diameter of 29 to 38 mm, a hardness difference in JIS-C hardness when determined at any point between its center to surface of the center of not more than 7, and a specific gravity lower than that of the intermediate layer, the surface hardness in JIS-C hardness of the intermediate layer is higher than the hardness when determined at any point in the center and the difference between the surface hardness of the intermediate layer and the hardness when determined at any point in the center is within the range of 3 to 20, and the cover has a Shore D hardness of less than 60.

In the three-piece solid golf ball of the present invention, it is preferable that the core 4 has a deformation amount of 2.70 to 4.50 mm when applying from an initial load of 10 kgf to a final load of 130 kgf, and the resulting golf ball has a ratio of spin amount (rpm) to launch angle (degree) (spin amount/launch angle) of less than 270 when hit by a No. 1 wood club at a head speed of 45 m/second.

DETAILED DESCRIPTION OF THE INVENTION

The three-piece solid golf ball of the present invention will be explained with reference to the accompanying drawing in detail. FIG. 1 is a schematic cross section illustrating one embodiment of the three-piece solid golf ball of the present invention. As shown in FIG. 1, the golf ball of the present invention comprises a core 4 composed of a center 1 and an intermediate layer 2 formed on the center 1, and a cover 3 covering the core 4. The center 1 and the intermediate layer 2 will be explained together, because they are formed from the same material. They are formed from a rubber composition comprising a base rubber, a co-crosslinking agent, an organic peroxide, an organic sulfide compound, and optionally a filler, an antioxidant and the like.

The base rubber used in the present invention may be natural rubber and/or synthetic rubber, which have been conventionally used for solid golf balls. Preferred is high-cis polybutadiene rubber containing not less than 40%, preferably not less than 80% of a cis-1, 4 bond. The high-cis polybutadiene rubber may be mixed with natural rubber, polyisoprene rubber, styrene-butadiene rubber, ethylene-propylene-diene rubber (EPDM) and the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.). The preferred co-crosslinking agent is zinc acrylate because it imparts high rebound characteristics to the resulting golf ball. The amount of the co-crosslinking agent in the rubber composition is from 20 to 40 parts by weight, preferably from 25 to 35 parts by weight in the center 1, and from 25 to 40 parts by weight, preferably from 28 to 38 parts by weight in the intermediate layer 2, based on 100 parts by weight of the base rubber. When the amount of the co-crosslinking agent is smaller than 20 parts by weight in the center 1, or is smaller than 25 parts by weight in the intermediate layer 2, the center or the intermediate layer is too soft, and the rebound characteristics are degraded, which reduces flight distance. On the other hand, when the amount of the co-crosslinking agent is larger than 40 parts by weight in the center 1 or the intermediate layer 2, the center or the intermediate layer is too hard, and shot feel is hard and poor.

The organic peroxide, which acts as a crosslinking agent or curing agent, includes, for example, dicumyl peroxide, 1,1-bis(t-butylperoxy)-3,3,5-trimethylcyclohexane, 2,5-dimethyl-2,5-di(t-butylperoxy)hexane, di-t-butyl peroxide and the like. The preferred organic peroxide is dicumyl peroxide. The amount of the organic peroxide is from 0.5 to 2.5 parts by weight, preferably 0.5 to 2.0 parts by weight in the center 1, and from 1.0 to 3.0 parts by weight, preferably 1.5 to 2.5 parts by weight in the intermediate layer 2, based on 100 parts by weight of the base rubber. When the amount of the organic peroxide is smaller than 0.5 parts by weight in the center 1, or smaller than 1.0 parts by weight in the intermediate layer 2, the center or the intermediate layer is too soft, and the rebound characteristics are degraded, which reduces flight distance. On the other hand, when the amount of the organic peroxide is larger than 2.5 parts by weight in the center 1, or larger than 3.0 parts by weight in the intermediate layer 2, the center or the intermediate layer is too hard, and the shot feel is poor.

The organic sulfide compound includes polysulfides having 2 to 4 sulfur atoms, such as diphenyl polysulfide, dibenzyl polysulfide, dibenzoyl polysulfide, dibenzothiazoyl polysulfide, dithiobenzoyl polysulfide and the like. Preferred organic sulfide compound is diphenyl disulfide, in view of rebound characteristics. An amount of the organic sulfide compound may be from 0.05 to 5.0 parts by weight, preferably from 0.1 to 4.0 parts by weight, based on 100 parts by weight of the base rubber. When the amount of the organic sulfide compound is smaller than 0.05 parts by weight, the technical effects accomplished by using the organic sulfide compound are not sufficiently obtained. On the other hand, when the amount of the organic sulfide compound is larger than 5.0 parts by weight, the technical effects are not improved more. By using the organic sulfide compound in the rubber composition for the core, the crosslinkage of the rubber by co-crosslinking agent shows high density, and rebound characteristics are improved.

The rubber composition for the core of the golf ball of the present invention can contain other components, which have been conventionally used for preparing the core of solid golf balls, such as an inorganic filler (such as zinc oxide, barium sulfate, calcium carbonate and the like), a high specific gravity metal powder filler (such as tungsten powder, molybdenum powder and the like), an organic sulfide compound, an antioxidant or an peptizing agent. If used, an amount of the antioxidant is preferably 0 to 1.0 parts by weight, more preferably 0.2 to 0.5 parts by weight, based on 100 parts by weight of the base rubber.

The center 1 is obtained by mixing the above rubber composition, and then vulcanizing and press-molding the mixture in a mold. The center 1 of the golf ball of the present invention has a diameter of 29 to 38 mm, preferably 30 to 38 mm, more preferably 31 to 38 mm. When the diameter is smaller than 29 mm, the technical effects accomplished by the presence of the center, such as rebound characteristics, are not sufficiently obtained. On the other hand, when the diameter is larger than 38 mm, the thickness of the intermediate layer is too thin, and the technical effects accomplished by the presence of the intermediate layer are not sufficiently obtained. In the three-piece solid golf ball consisting of a center, an intermediate layer and a cover, the rebound characteristics of the center have great influence on those of the golf ball, and the size and rebound characteristics of the center are important factors that determine the rebound characteristics of the golf ball. The larger the diameter of the center, and the better the rebound characteristics, thus the better the rebound characteristics of the golf ball.

The center 1 of the golf ball of the present invention has a hardness difference in JIS-C hardness, when determined at any point between its center to surface of the center, is not more than 7, preferably 2 to 5. When the hardness difference is more than 7, the rebound characteristics are degraded. The hardness difference, which is not more than 7, is preferably small and uniform. When the hardness difference is more than 7, the center is soft, the rebound characteristics and durability are degraded.

It is desired that the center 1 have a center hardness in JIS-C hardness of 65 to 80, preferably 68 to 79. When the center hardness is lower than 65, the center is too soft, the rebound characteristics are degraded. On the other hand, when the center hardness is higher than 80, the center is too hard, the shot feel is poor. It is desired that the center 1 have the surface hardness in JIS-C hardness of 65 to 85, preferably 68 to 82. When the surface hardness is lower than 65, the center is too soft, the rebound characteristics are degraded. On the other hand, when the surface hardness is higher than 85, the center is too hard, the shot feel is poor. The term "hardness of a center" other than the surface hardness of the center as used herein refers to a hardness, which is obtained by cutting the center into two equal parts and then measuring a hardness. The intermediate layer 2 is then formed on the center 1.

A method of forming the intermediate layer 2 is not specifically limited, but may be a well-known method, which has been conventionally used for forming golf ball cover. For example, there can be used a method comprising molding the intermediate layer composition into a semi-spherical half-shell, covering the center with the two half-shells, followed by pressure molding, or a method comprising injection molding the intermediate layer composition directly on the center to cover it.

In the golf ball of the present invention, the specific gravity of the center 1 is not more than that of the intermediate layer 2. The surface hardness in JIS-C hardness of the intermediate layer 2 is higher than the hardness when determined at any point in the center 1, and the difference between the surface hardness of the intermediate layer and the hardness of the center is within the range of 3 to 20, preferably 3 to 15. When the specific gravity of the center is higher than that of the intermediate layer, the rebound characteristics of the center are much degraded, and those of the resulting golf ball are degraded, because it is required to formulate a large amount of filler in the center. Therefore, it is required that the specific gravity of the center 1 is not more than that of the intermediate layer 2, in order to maintain good rebound characteristics.

The specific gravity of the center 1 may be within the range of 1.00 to 1.20, preferably 1.02 to 1.18. When the specific gravity of the center is lower than 1.00, it is required to formulate a filler having a specific gravity of not more than 1, and the rebound characteristics of the resulting golf ball are degraded, because the rebound characteristics of the center have great influence on those of the golf ball. On the other hand, when the specific gravity of the center is more than 1.20, the rebound characteristics of the resulting golf ball are degraded, because it is required to formulate a large amount of filler in the center. The specific gravity of the intermediate layer may be within the range of 1.10 to 1.35, preferably 1.12 to 1.32. When the specific gravity of the intermediate layer is lower than 1.10, the rebound characteristics of the resulting golf ball are degraded as described above, because it is required to heighten the specific gravity of the center. On the other hand, when the specific gravity is more than 1.35, the rebound characteristics of the intermediate layer are degraded, because it is required to formulate a large amount of filler in the intermediate layer.

When the difference between the surface hardness of the intermediate layer and the hardness of the center is lower than 3, the launch angle at the time of hitting by a golf club is small, the spin amount is large, and the flight distance is reduced. On the other hand, when the difference between the surface hardness of the intermediate layer and the hardness of the center is more than 20, the durability is degraded. The surface hardness of the intermediate layer in JIS-C hardness may be within the range of 80 to 95, preferably 82 to 93. When the surface hardness of the intermediate layer is lower than 80, the intermediate layer is too soft, the launch angle is small, the spin amount is large, and the flight distance is reduced. On the other hand, when the surface hardness of the intermediate layer is higher than 95, the intermediate layer is too hard, and the shot feel is poor.

In the golf ball of the present invention, it is required that the hardness of the core 4 formed the intermediate layer 2 on the center 1 is not very high. Therefore, it is desired that the core 4 of the golf ball of the present invention have a deformation amount of 2.70 to 4.50 mm, preferably 2.70 to 4.00 mm, more preferably 2.80 to 3.50 mm when applying from an initial load of 10 kgf to a final load of 130 kgf on the core. When the deformation amount is smaller than 2.70 mm, the core is too hard, and the shot feel of the resulting golf ball is poor. On the other hand, when the deformation amount is larger than 4.50 mm, the core is too soft, and the rebound characteristics are degraded, which reduces flight distance. The core 4 has a diameter of 38 to 41 mm. When the diameter is smaller than 38 mm, the rebound characteristics of the resulting golf ball are degraded. On the other hand, when the diameter is larger than 41 mm, the cover is too thin, and the durability is degraded. The cover 3 is then covered on the core 4.

The material used for the cover 3 of the present invention includes thermoplastic resin, particularly ionomer resin or mixtures thereof. The ionomer resin may be a copolymer of α-olefin and α,β-unsaturated carboxylic acid having 3 to 8 carbon atoms, of which a portion of carboxylic acid groups is neutralized with metal ion. Examples of the α-olefins in the ionomer preferably include ethylene, propylene and the like. Examples of the α,β-unsaturated carboxylic acid in the ionomer preferably include acrylic acid, methacrylic acid and the like. The metal ion which neutralizes a portion of carboxylic acid groups of the copolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum, a neodymium ion and the like; and mixture thereof. Preferred are sodium ions, zinc ions, lithium ions and the like, in view of rebound characteristics, durability and the like. The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1705, Hi-milan 1706, Hi-milan 1707, Hi-milan 1855, Hi-milan 1856 and the like. Examples of the ionomer resins, which are commercially available from Du Pont Co., include Surlyn AD8511, Surlyn AD8512 and the like. Examples of the ionomer resins, which are commercially available from Exxon Chemical Co., include Iotek 7010, Iotek 8000 and the like. These ionomer resins may be used alone or in combination.

As the materials used in the cover of the present invention, the above ionomer resin may be used alone, but the ionomer resin may be suitably used in combination with a specific elastomer or resin. Examples of the combinations thereof include:

(i) a heat mixture of an ionomer resin, an acid-modified thermoplastic elastomer or thermoplastic elastomer having terminal OH groups, and an SBS (styrene-butadiene-styrene) block copolymer having polybutadiene portion with epoxy groups or SIS (styrene-isoprene-styrene) block copolymer having polyisoprene portion with epoxy groups, (ii) a heat mixture of an ionomer and a terpolymer of ethylene-unsaturated carboxylic acid ester-unsaturated carboxylic acid, (iii) a heat mixture of an ionomer, a maleic anhydride-modified thermoplastic elastomer and a glycidyl group-modified thermoplastic elastomer.

The intermediate layer may optionally contain fillers and the like, in addition to the resin component as main component. Examples of fillers include inorganic filler (such as zinc oxide, barium sulfate, calcium carbonate and the like), high specific gravity metal powder filler (such as tungsten powder, molybdenum powder and the like), and the mixture thereof.

The cover used in the present invention may optionally contain fillers (such as barium sulfate, calcium carbonate, etc.), pigments (such as titanium dioxide, etc.), and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover. An amount of the pigment is preferably 0.1 to 0.5 parts by weight, based on 100 parts by weight of the resin component for the cover.

The cover 3 of the present invention has a Shore D hardness of from 45 to less than 60, preferably 50 to less than 60, more preferably 52 to 58, because of increasing the spin amount in order to stop the hit golf ball on the green easily when hit by a short iron club and the like. When the Shore D hardness is smaller than 45, the spin amount is too large, the flight distance is reduced. On the other hand, when the Shore D hardness is not less than 60, the spin amount is small when hit by a short iron club, and it is difficult to stop the hit golf ball. The cover 3 has a thickness of 1.0 to 3.0 mm, preferably 1.0 to 2.0 mm. When the thickness is smaller than 1.0 mm, the technical effects accomplished by the presence of the cover are not sufficiently obtained. On the other hand, when the thickness is larger than 3.0 mm, the shot feel is poor.

A method of covering the core with the cover 3 is not specifically limited, but may be the same method as used in the intermediate layer. At the time of molding the cover, many depressions called "dimples" may be optionally formed on the surface of the golf ball. Furthermore, paint finishing or marking with a stamp may be optionally provided after the cover is molded for commercial purpose. The three-piece solid golf ball of the present invention is formed, so that it has a diameter of not less than 42.67 mm and a weight of not more than 45.93 g, according to the PGA rule.

In addition, it is preferable that the launch angle of the golf ball is large when hit by a golf club and the spin amount is low, in order to increase the flight distance when hit by a driver or a long iron club to a middle iron club. It is important that the golf ball of the present invention has the correlation between the launch angle and the spin amount, that is, the ratio of spin amount to launch angle (spin amount/launch angle) of less than 270, preferably 200 to less than 270, more preferably 220 to 265, most preferably 240 to 260 when hit by a No. 1 wood club (a driver) at a head speed of 45 m/second. The ratio of spin amount to launch angle (spin amount/launch angle) is an index shown an initial condition of flight performance. When the value of the ratio is larger, the spin amount is higher and the launch angle is lower. On the other hand, when the value of the ratio is smaller, the spin amount is lower and the launch angle is higher. When the ratio when hit by a No. 1 wood club is not less than 270, the golf ball creates blown-up trajectory, and the flight distance is reduced.

When hit by a No. 1 wood club (a driver) at a head speed of 45 m/second, the launch angle is 10.0 to 12.5 degrees, preferably 10.5 to 12.0 degrees. When the launch angle is smaller than 10.0 degrees, the trajectory is too low, and the flight distance is reduced. On the other hand, when the launch angle is larger than 12.5 degrees, the trajectory is too high, the golf ball is blowy and the controllability is degraded. When hit by a No. 1 wood club (a driver) at a head speed of 45 m/second, the spin amount is 2000 to 3500 rpm, preferably 2500 to 3000 rpm. When the spin amount is lower than 200 rpm, the flight distance is reduced. On the other hand, when the spin amount is higher than 3500 rpm, the flight distance is reduced.

EXAMPLES

The following Examples and Comparative Examples further illustrate the present invention in detail but are not to be construed to limit the scope of the present invention.

Examples 1 to 5 and Comparative Examples 1 to 6

Production of Center

The rubber compositions for the center shown in Table 1 (Examples) and Table 2 (Comparative Examples) were mixed with a mixing roll, and then vulcanized by press-molding at the vulcanizing condition shown in the same Tables to obtain spherical centers having the diameter and the specific gravity shown in the same Tables. The hardness distribution, diameter and specific gravity of the resulting centers were measured. The results are shown in Tables 4 (Examples) and Table 5 (Comparative Examples). The test methods are described later.

Formation of Intermediate Layer

The rubber compositions for the intermediate layer shown in Table 1 (Examples) and Table 2 (Comparative Examples) were molded into a semi-spherical half-shell, the center as described above was covered with the two semi-spherical half-shells, followed by pressure molding in a mold at the vulcanizing condition shown in the same Tables, to obtain cores having two-layer structure. The surface hardness and specific gravity of the resulting intermediate layers were measured. The results are shown in Tables 4 (Examples) and Table 5 (Comparative Examples). The deformation amounts of the resulting cores when applying from an initial load of 10 kgf to a final load of 130 kgf were measured. The results are shown in Tables 4 (Examples) and Table 5 (Comparative Examples). The test methods are described later.

TABLE 1

| Example No. | 1 | 2 | 3 | 4 | 5 |
|---|---|---|---|---|---|
| (Center composition) | | | | | |
| Butadiene rubber *1 | 100 | 100 | 100 | 100 | 100 |
| Zinc acrylate | 25 | 28 | 28 | 26 | 29 |
| Zinc oxide | 20 | 18 | 18 | 5 | 18 |
| Diphenyl disulfide | 0.4 | 0.4 | 0.4 | 0.4 | 0.4 |
| Dicumyl peroxide | 1.4 | 1.4 | 1.4 | 1.4 | 1.4 |
| Vulcanization condition | *I | *I | *II | *I | *I |
| (Intermediate layer composition) | | | | | |
| Butadiene rubber *1 | 100 | 100 | 100 | 100 | 100 |
| Zinc acrylate | 30 | 30 | 30 | 30 | 30 |
| Zinc oxide | 20 | 18 | 18 | 20 | 20 |
| Tungsten | — | — | — | 13 | — |
| Diphenyl disulfide | 0.4 | 0.4 | 0.4 | 0.4 | 0.4 |
| Dicumyl peroxide | 2.0 | 2.0 | 2.0 | 2.0 | 2.0 |
| Vulcanization condition | *III | *III | *III | *IV | *V |

TABLE 2

| Comparative Example No. | 1 | 2 | 3 | 4 | 5 | 6 |
|---|---|---|---|---|---|---|
| (Center composition) | | | | | | |
| Butadiene rubber *1 | 100 | 100 | 100 | 100 | 100 | 100 |
| Zinc acrylate | 25 | 28 | 28 | 28 | 26 | 31 |
| Zinc oxide | 20 | 20 | 18 | 18 | 5 | 17.5 |
| Tungsten | — | 16 | — | — | — | — |
| Diphenyl disulfide | 0.4 | 0.4 | 0.4 | 0.4 | 0.4 | 0.4 |
| Dicumyl peroxide | 1.4 | 1.4 | 1.4 | 1.4 | 1.4 | 1.4 |
| Vulcanization condition | *I | *I | *VI | *I | *I | *I |
| (Intermediate layer composition) | | | | | | |
| Butadiene rubber *1 | 100 | 100 | 100 | 100 | 100 | 100 |
| Zinc acrylate | 30 | 30 | 30 | 30 | 30 | 30 |
| Zinc oxide | 20 | 5 | 18 | 18 | 20 | 18 |
| Tungsten | — | — | — | — | 13 | — |
| Diphenyl disulfide | 0.4 | 0.4 | 0.4 | 0.4 | 0.4 | 0.4 |
| Dicumyl peroxide | 2.0 | 2.0 | 2.0 | 2.0 | 2.0 | 1.4 |
| Vulcanization condition | *III | *V | *III | *VII | *IV | *VIII |

Vulcanization condition
*I: at 140° C. for 19 minutes, and then 168° C. for 6 minutes
*II: at 145° C. for 17 minutes, and then 168° C. for 6 minutes
*III: at 160° C. for 20 minutes
*IV: at 152° C. for 20 minutes
*V: at 162°0 C. for 20 minutes
*VI: at 155° C. for 22 minutes
*VII: at 154° C. for 20 minutes
*VIII: at 164° C. for 20 minutes
*1: High-cis Polybutadiene rubber (trade name "BR11") available from JSR Co., Ltd.

Preparation of Cover Compositions

The formulation materials shown in Table 3 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C at the die position of the extruder. The Shore D hardness of the resulting cover composition was measured. The results are shown in Table 4 and Table 5. The test methods are described later.

TABLE 3

| Cover composition | (parts by weight) A | B | C | D |
|---|---|---|---|---|
| Surlyn AD8511 *2 | 25 | 30 | 27.5 | — |
| Surlyn AD8512 *3 | 25 | 30 | 27.5 | — |
| Hi-milan 1557 *4 | — | — | — | 30 |
| Hi-milan 1707 *5 | — | — | — | 20 |
| Hi-milan 1855 *6 | — | — | — | 50 |
| Epofriend A1010 *7 | 15 | 10 | 12.5 | — |
| Cepton HG-252 *8 | 35 | 30 | 32.5 | — |

*2: Surlyn AD8511 (trade name), ethylene-methacrylic acid copolymer ionomer resin obtained by neutralizing with zinc ion, manufactured by DuPont Co., MI = 3.4, flexural modulus = about 220 MPa

*3: Surlyn AD8512 (trade name), ethylene-methacrylic acid copolymer ionomer resin obtained by neutralizing with sodium ion, manufactured by DuPont Co., MI = 4.4, flexural modulus = about 280 MPa

*4: Hi-milan 1557 (trade name), ethylene-methacrylic acid copolymer ionomer resin obtained by neutralizing with zinc ion, manufactured by Mitsui Du Pont Polychemical Co., Ltd., MI = 5.0, flexural modulus = about 215 MPa

*5: Hi-milan 1707 (trade name), ethylene-methacrylic acid copolymer ionomer resin obtained by neutralizing with sodium ion, manufactured by Mitsui Du Pont Polychemical Co., Ltd., MI = 0.9, flexural modulus = about 275 MPa

*6: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd., MI = 1.0, flexural modulus = about 87 MPa

*7: Epofriend AT1010 (trade name), styrene-butadiene-styrene (SBS) block copolymer with epoxy groups, manufactured by Daicel Chemical Industries, Ltd., JIS-A hardness = 67, styrene/butadiene (weight ratio) = 40/60, content of epoxy = about 1.5 to 1.7% by weight

*8: Septon HG-252 (trade name), hydrogenated styrene-isoprene-styrene (SIS) block copolymer having a terminal OH group, manufactured by Kuraray Co. Ltd., JIS-A hardness = 80, content of styrene = about 40% by weight Production of Golf Ball The cover compositions shown in Table 4 (Example) and Table 5 (Comparative Example) were covered on the resulting core by injection molding. Then, deflashing, surface pretreatment for painting, paint and the like, which are generally done on the surface of a golf ball, were conducted on the surface to produce a golf ball having a weight of 45.4 g and a diameter of 42.76 mm. With respect to the resulting golf balls, the coefficient of restitution and flight distance were measured. The results are shown in Table 6 (Example) and Table 7 (Comparative Example). As the flight performance, launch angle, spin amount and flight distance (carry and total) when hit by a driver, and spin amount and flight distance (carry, total and run) when hit by a sand wedge were measured or evaluated. The test methods are as follows.

(Test Method)

(1) Deformation Amount

The deformation amount was determined by measuring a deformation amount when applying an initial load of 10 kg to a final load of 130 kg on the core.

(2) Shore D Hardness of Cover

The Shore D hardness of the cover was determined by measuring a Shore D hardness of the surface of the resulting golf ball (the surface of the cover).

(3) Coefficient of Restitution

A metal cylinder was fired to strike against a golf ball at a speed of 45 cm/sec, and the velocity of the golf ball after strike was measured. The coefficient of restitution of the golf ball was calculated from the velocity and the weight of the cylinder and golf ball.

(4) Flight Distance

A No.1 wood club (W#1, a driver) was mounted to a swing robot manufactured by True Temper Co. and the golf ball was hit at a head speed of 45 m/second, the launch angle, flight distance and spin amount were measured. As a flight distance, carry that is a flight distance to the firstly dropping point on the ground and total (total distance) were measured. The spin amount was measured by continuously taking a photograph of a mark provided on the hit golf ball using a high-speed camera.

After a sand wedge (SW) was mounted to a swing robot manufactured by True Temper Co. and the golf ball was hit at head speed of 21 m/sec, the flight distance and spin amount were measured. As the flight distance, carry, total and run were measured. Run is a flight distance subtracted carry from total. As golf clubs used, the driver is "Tangent Titanium 270" (shaft hardness: S, loft angle: 10.5°), manufactured by Sumitomo Rubber Industries, Ltd., the sand wedge is "DP601 Promodel" (shaft hardness: S, loft angle: 57°), manufactured by Sumitomo Rubber Industries, Ltd.

TABLE 4

| Example No. | 1 | 2 | 3 | 4 | 5 |
|---|---|---|---|---|---|
| (Center) | | | | | |
| JIS-C hardness | | | | | |
| Center point | 75 | 78 | 72 | 72 | 79 |
| 5 mm from center point | 75 | 78 | 74 | 72 | 79 |
| 10 mm from center point | 75 | 78 | 75 | 73 | 80 |
| 15 mm from center point | 76 | 78 | 79 | — | 80 |
| Surface | 76 | 78 | 79 | 73 | 80 |
| Average (a) | 75 | 78 | 76 | 73 | 80 |
| Diameter (mm) | 34 | 31 | 31 | 29 | 31 |
| Specific gravity | 1.13 | 1.13 | 1.13 | 1.04 | 1.13 |
| (Intermediate layer) | | | | | |
| Surface hardness (b) (JIS-C) | 84 | 84 | 84 | 84 | 86 |
| Hardness difference (b-a) | 9 | 6 | 8 | 11 | 6 |
| Specific gravity | 1.14 | 1.13 | 1.13 | 1.23 | 1.14 |
| (Core) | | | | | |
| Diameter (mm) | 39.1 | 39.1 | 39.1 | 39.1 | 39.1 |
| Deformation amount (mm) | 3.15 | 2.95 | 3.10 | 3.20 | 2.75 |
| (Cover) | | | | | |
| Composition | A | B | A | C | B |
| Shore D hardness | 51 | 58 | 51 | 56 | 58 |

TABLE 5

| Comparative Example No. | 1 | 2 | 3 | 4 | 5 | 6 |
|---|---|---|---|---|---|---|
| (Core) | | | | | | |
| JIS-C hardness | | | | | | |
| Center point | 75 | 78 | 67 | 78 | 72 | 80 |
| 5 mm from center point | 75 | 78 | 72 | 78 | 72 | 80 |
| 10 mm from center point | 75 | 79 | 73 | 78 | 73 | 81 |
| 15 mm from center point | — | 79 | 78 | 78 | — | 81 |
| Surface | 75 | 79 | 78 | 78 | 73 | 81 |
| Average (a) | 75 | 79 | 74 | 78 | 73 | 81 |
| Diameter (mm) | 27 | 31 | 31 | 31 | 29 | 31 |
| Specific gravity | 1.13 | 1.25 | 1.13 | 1.13 | 1.04 | 1.13 |
| (Intermediate layer) | | | | | | |

TABLE 5-continued

| Comparative Example No. | 1 | 2 | 3 | 4 | 5 | 6 |
|---|---|---|---|---|---|---|
| Surface hardness (b) (JIS-C) | 84 | 84 | 84 | 78 | 84 | 88 |
| Hardness difference (b-a) | 9 | 5 | 10 | 0 | 11 | 7 |
| Specific gravity | 1.14 | 1.05 | 1.13 | 1.13 | 1.23 | 1.13 |
| (Core) | | | | | | |
| Diameter (mm) | 39.1 | 39.1 | 39.1 | 39.1 | 39.1 | 39.1 |
| Deformation amount (mm) | 3.00 | 2.90 | 3.23 | 3.15 | 3.20 | 2.60 |
| (Cover) | | | | | | |
| Composition | A | B | A | B | D | B |
| Shore D hardness | 51 | 58 | 51 | 58 | 63 | 58 |

TABLE 6

| Example No. | 1 | 2 | 3 | 4 | 5 |
|---|---|---|---|---|---|
| (Ball) | | | | | |
| Coefficient of restitution | 0.7610 | 0.7630 | 0.7602 | 0.7680 | 0.7675 |
| Flight performance (W#1, 45 m/second) | | | | | |
| Spin amount (rpm) | 2855 | 2815 | 2850 | 2788 | 2903 |
| Launch angle (°) | 11.28 | 11.21 | 11.25 | 11.3 | 11.15 |
| Ratio of spin amount/ launch angle | 253 | 251 | 253 | 247 | 260 |
| Carry (yard) | 224.0 | 225.0 | 224.5 | 225.5 | 224.8 |
| Total (yard) | 242.5 | 244.4 | 243.1 | 244.8 | 243.2 |
| Flight performance (SW, 21 m/second) | | | | | |
| Spin amount (rpm) | 6858 | 6559 | 6883 | 6647 | 6613 |
| Carry (yard) | 34.9 | 35.5 | 35.1 | 35.3 | 35.0 |
| Total (yard) | 39.0 | 39.0 | 39.3 | 39.6 | 39.6 |
| Run (yard) | 4.1 | 4.5 | 4.2 | 4.3 | 4.6 |

TABLE 7

| Comparative Example No. | 1 | 2 | 3 | 4 | 5 | 6 |
|---|---|---|---|---|---|---|
| (Ball) | | | | | | |
| Coefficient of restitution | 0.7550 | 0.7503 | 0.7563 | 0.7584 | 0.7728 | 0.7704 |
| Flight performance (W#1, 45 m/second) | | | | | | |
| Spin amount (rpm) | 2928 | 2833 | 2838 | 2988 | 2758 | 3108 |
| Launch angle (°) | 11.1 | 11.18 | 11.28 | 10.96 | 11.42 | 11.05 |
| Ratio of spin amount/launch angle | 264 | 253 | 252 | 273 | 242 | 281 |
| Carry (yard) | 221.5 | 219.3 | 221.8 | 220.2 | 226.8 | 221.3 |
| Total (yard) | 239.4 | 237.5 | 240.2 | 239.6 | 245.6 | 238.6 |
| Flight performance (SW, 21 m/second) | | | | | | |
| Spin amount (rpm) | 6938 | 6584 | 6813 | 6503 | 6100 | 6638 |
| Carry (yard) | 34.8 | 35.2 | 34.9 | 35.0 | 35.9 | 35.2 |
| Total (yard) | 39.1 | 39.8 | 39.0 | 39.9 | 42.0 | 39.7 |
| Run (yard) | 4.3 | 4.6 | 4.1 | 4.9 | 6.1 | 4.5 |

As is apparent from the comparison of the physical properties of the golf balls of Examples 1 to 5 shown in Table 6 with those of the golf balls of Comparative Examples 1 to 6 shown in Table 7, the golf balls of the present invention of Examples. 1 to 5 have longer flight distance when hit by a driver, shorter run and better spin performance when hit by a sand wedge than the golf ball of Comparative Examples 1 to 6.

On the other hand, in the golf ball of Comparative Example 1, the coefficient of restitution is small, and the flight distance is small, because the diameter of the center is small. In the golf ball of Comparative Example 2, the coefficient of restitution is small, and the flight distance is small, because the amount of the filler in the center is large and the specific gravity of the center is larger than that of the intermediate layer. In the golf ball of Comparative Example 3, the rebound characteristics are degraded, which reduces flight distance, because the hardness distribution of the center.

In the golf ball of Comparative Example 4, the launch angle is small, the spin amount is large, and the flight distance is small, because the ratio of the spin amount/launch angle is large. In the golf ball of Comparative Example 5, the run is small, and it is difficult to stop, because the hardness of the cover is high, and the spin amount is small when hit by a sand wedge. In the golf ball of Comparative Example 6, the launch angle is small, the spin amount is large, and the flight distance is small, because the ratio of the spin amount/launch angle is large. In addition, the core is hard, and the shot feel is poor, because the formation amount when applying from an initial load of kgf to a final load of 130 kgf is small.

What is claimed is:

1. A three-piece solid golf ball comprising a core composed of a center and an intermediate layer formed on the center, and a cover covering the core, wherein the center has a diameter of 29 to 38 mm, a hardness difference in JIS-C hardness when determined at any point between a center point to surface of the center of not more than 7, and a specific gravity lower than that of the intermediate layer, the surface hardness in JIS-C hardness of the intermediate layer is higher than the hardness when determined at any point in the center and the difference between the surface hardness of the intermediate layer and the hardness when determined at any point in the center is within the range of 3 to 20, the cover has a Shore D hardness of less than 60 and wherein both the center and the intermediate layer are formed by vulcanizing a rubber composition comprising a base rubber, a co-crosslinking agent and an organic peroxide.

2. The golf ball according to claim 1, wherein the core has a deformation amount of 2.70 to 4.50 mm when applying from an initial load of 10 kgf to a final load of 130 kgf.

3. The golf ball according to claim 1, wherein the golf ball has a ratio of spin amount to launch angle (spin amount/launch angle) of less than 270 when hit by a No. 1 wood club at a head speed of 45 m/second.

4. A three-piece solid golf ball comprising a core composed of a center and an intermediate layer formed on the center, and a cover covering the core, wherein the center has a diameter of 29 to 38 mm, a hardness difference in JIS-C hardness when determined at any point between a center point to surface of the center of not more than 7, and a specific gravity lower than that of the intermediate layer, the surface hardness in JIS-C hardness of the intermediate layer is higher than the hardness when determined at any point in the center and the difference between the surface hardness of the intermediate layer and the hardness when determined at any point in the center is within the range of 3 to 20, the cover has a Shore D hardness of less than 60, and the golf ball has a ratio of spin amount to launch angle (spin amount/launch angle) of less than 270 when hit by a No. 1 wood club at a head speed of 45 m/second.

5. The three-piece solid golf ball according to claim 4 wherein the difference between the surface hardness of the intermediate layer and the hardness when determined at any point in the center is within the range of 3 to 15.

6. The three-piece solid golf ball according to claim 4 wherein the center has a specific gravity of 1.00 to 1.20.

7. The three-piece solid golf ball according to claim 4 wherein both the center and the intermediate layer are formed by vulcanizing a rubber composition comprising a base rubber, a co-crosslinking agent and an organic peroxide.

* * * * *